US007846221B2

(12) United States Patent
Murakami

(10) Patent No.: US 7,846,221 B2
(45) Date of Patent: Dec. 7, 2010

(54) METHOD FOR TREATING OF OILS AND FATS

(76) Inventor: Seishiro Murakami, 1899, Takagi, Mihune-mati Kamimashiki-gun, Kumamoto, 861-3203 (JP)

( * ) Notice: Subject to any disclaimer, the term of this patent is extended or adjusted under 35 U.S.C. 154(b) by 1198 days.

(21) Appl. No.: 10/584,160

(22) PCT Filed: Dec. 21, 2004

(86) PCT No.: PCT/JP2004/019678

§ 371 (c)(1),
(2), (4) Date: Jun. 22, 2006

(87) PCT Pub. No.: WO2005/063951

PCT Pub. Date: Jul. 14, 2005

(65) Prior Publication Data

US 2007/0148310 A1 Jun. 28, 2007

(30) Foreign Application Priority Data

Dec. 25, 2003 (JP) ..... 2003-429573

(51) Int. Cl.
*C10L 1/18* (2006.01)

(52) U.S. Cl. ..... 44/308; 204/157.15; 204/157.6; 204/157.87; 204/158.21

(58) Field of Classification Search ..... 44/308; 204/157.15, 157.6, 157.87, 158.21
See application file for complete search history.

(56) References Cited

FOREIGN PATENT DOCUMENTS

| | | | |
|---|---|---|---|
| JP | 07053974 | * | 2/1995 |
| JP | 2004238478 | * | 8/2004 |

* cited by examiner

*Primary Examiner*—Cephia D Toomer
(74) *Attorney, Agent, or Firm*—Flynn, Thiel, Boutell & Tanis, P.C.

(57) ABSTRACT

A method for treatment of oils and fats having a high saturated fatty acid content whose treatment has previously been difficult, especially waste oils and fats and discharged oils and fats, characterized in that the oils and fats just prior to hydrolysis is subjected to ozone treatment and light irradiation treatment.

9 Claims, 5 Drawing Sheets

METHOD FOR TREATING OF OILS AND FATS

FIELD OF THE INVENTION

The present invention relates to a method for treatment of oils and fats, in particular, relates to a method for treatment of oils and fats characterized by making it possible to reuse treated wasted oils and fats or treated discharged oils and fats not depending on the amount of saturated fatty acid•unsaturated fatty acid.

DESCRIPTION OF THE PRIOR ART

Presently, there are many sorts of wasted oils and fats in Japan. For example, tallow, bovine born oil, bovine internal organ oil, lard, pig bone oil, pig internal organ oil, chicken oils and fats, residue oil formed at a refining process of animal oils and fats or vegetable oils and fats, animal foots oil or vegetable foots oil formed from rendering animal oils and fats or vegetable oils and fats, strong alkaline dark oil formed at a treating process of a foots oil, various wasted animal oils and fats or vegetable oils and fats discharged from a food processing factory, waste oils and fats discharged from a production process of purified oil for food as a by-product, for example, discharged oil generally called as "oil foots" at a producing process of beans oil, rapeseed oil or corn oil or waste foods oil such as waste oil from deep-fried food processing. Nowadays, it is said that the total amount of these waste oils for a year is more than 10 million tons or more than 20 million tons.

Further, from the occurrence of mad cow disease, it became necessary to treat and burn up bovine-originated oils and fats separately from other oils and fats. However, since the calories of bovine-originated oils and fats is high, the durability of a burning furnace becomes a problem and safe burning of it cannot be expected. Therefore, it was necessary to preserve waste bovine-originated oils and fats separately until a treating method was developed, however, actually, bovine-originated oils and fats are mixed with other oils and fats and are not controlled as obligated. Therefore, a development of a new treating method is becoming a pressing subject.

Regarding animal oils and fats, except for bovine-originated oils and fats, although a part of it is used as a fodder for a domestic animal, foods or cosmetic composition, mostly is burned. Regarding residue oil formed at a refining process of animal oils and fats or vegetable oils and fats for food, since said residue oil is mainly strong alkaline waste oils and fats, the durability of an ordinary furnace is a problem and, accordingly, treatment by burning is impossible.

A part of waste food oil is used as a fuel for Diesel engines by converting by the "methylesterfication method". This method can be illustrated as follows. That is, methanol or ethanol and sodium hydroxide are mixed with a waste food oil with constant stirring, then the mixture is left to stand. Glycerin or others, which are impurities, are absorbed by methanol or ethanol and separate to an upper side when maintained in a standing state. Oil, which is located at a lower side, is used as a fuel. However, this method can only be applied for the refining of high quality waste food oil and cannot be applied for refining of middle quality waste food oil, low quality food oil or mud waste foots oil. The reason why can be illustrated as follows. That is, the "methylesterfication method" is a technique developed 50 or 60 years ago to convert a virgin oil such as soy bean oil or rapeseed oil to a fuel and cannot be applied to a used waste food oil which is characterized in that the oxidation degree has progressed to a higher level. Therefore, middle quality waste food oil, low quality food oil or mud waste foots oil are omitted from the object of refining by this method. Further, oils and fats having a high ratio of saturated fatty acids are out of the discussion. Furthermore, a method of "conversion of waste food oil, fish oil to Diesel engine fuel by ozone treatment, is also applied. This method is a technique objected to for oils and fats whose ratio of saturated fatty acids is high (for example, soy beans oil, rape seed oil, corn oil, camellia oil or fish oil).

This method is a technique of pouring materials to be treated (oils and fats characterized in that the content of unsaturated fatty acid is high) into a reaction tank and ozone is added from a lower position of the reaction tank, then, the double bond of the unsaturated fatty acids is dissociated by oxidization by ozone and thus converts the material to a fuel. Therefore, a waste oil whose content of unsaturated fatty acid is high (high quality, middle quality, low quality and mud oil) can be refined by this method, however, oils and fats whose melting point is high and concentration of saturated fatty acids is high, such as palm oil, residue oil of palm oil, coconut oil or residue oil of coconut oil, cannot be treated by this method. Further, said method cannot be applied to a strong alkaline waste oil too. For example, in a case when oils and fats whose content of saturated fatty acids is high is treated by this method, large amount of ozone is added to dissociate the double bonds of the fatty acid. When the amount of ozone added becomes large and the time of adding also becomes long, consequently, the saturated fatty acids cause polymerizing reactions by the ozone reaction. The polymerizing reactions mean a state that the oils and fats cause caking.

Oils and fats can be roughly classified into saturated fatty acids and unsaturated fatty acids. When the content of saturated fatty acids becomes large, the melting point and caking ratio become high and solidification occurs quickly. As oils and fats whose content of saturated fatty acids is larger than 80%, tallow (Fedd oil), bovine born oil, pig oil (lard), pig bone oil, chicken oil, sheep oil, goat oil or horse oil can be mentioned. As a vegetable oil, palm oil, residue oil of palm oil, coconut oil and residue oil of coconut oil can be mentioned.

As oils and fats which contain more than 80% of unsaturated fatty acids, soy bean oil, rape seed oil, sunflower oil or corn oil can be mentioned as a vegetable oil, and fish oil can be mentioned as an animal oil.

Because unsaturated fatty acids can be more easily treated than saturated fatty acids, the development has progressed on oils and fats whose content of unsaturated fatty acids is high.

SUMMARY OF THE INVENTION

The present invention relates to a treating method of oils and fats and the object of the present invention is to provide a material for various oils and fats, such as a fuel, by treating oils and fats whose content of saturated fatty acids is high.

The gist of the present invention is a treating method of oils and fats characterized in carrying out ozone and light irradiation treatments on oils and fats in a state prior to hydrolysis.

Figure 1:
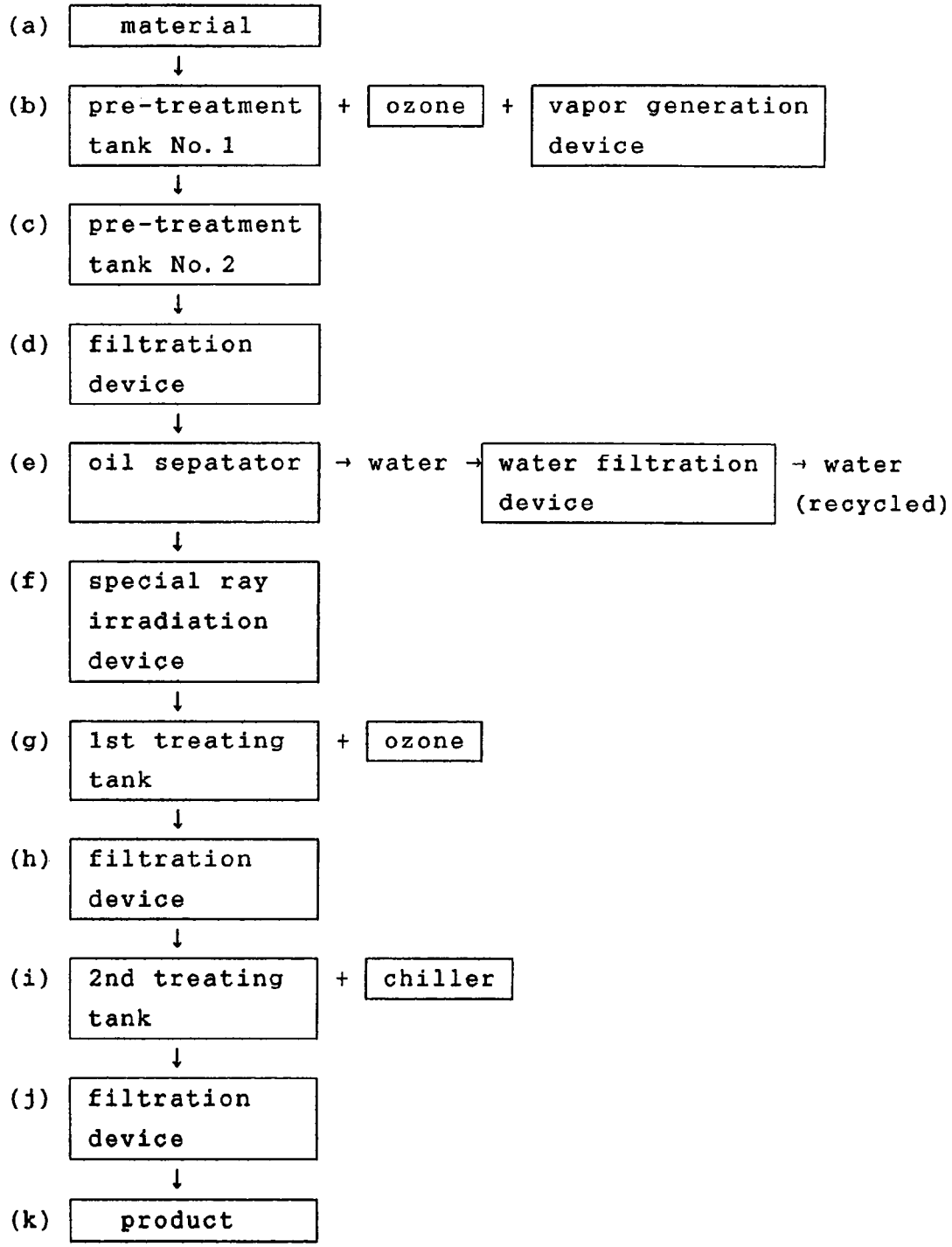
FIG. 1 is a flow sheet illustrating a process of the present invention.

1. Material tank, 2. First pre-treatment tank, 3. Second pre-treatment tank, 4. Pre-filtration filter press, 5. Pre-coating tank, 6. Oil separator, 7. Special ray irradiation device, 8. First treating tank, 9. Cooling chiller, 10. Second filtration device, 11. Pre-coating tank, 12. Second treating tank, 13. Third filtration device, 14. Pre-coating tank, 15. Regulating tank, 16. Cartridge tank, 17. Vapor generating device, 18. Ozone generating device, 19. Ozone inserting opening, 20. Material gas pipe, 21. First tank (liquidizing tank), 22. Second tank (liquid recovering tank), 23. Filtration device, 24. Liquefied gas fuel tank, 25. Stirrer 26. Filter, 27. Lubricating oil recovering device

DESCRIPTION OF THE PREFERRED EMBODIMENT

The present invention will now be illustrated in more detail.

Regarding waste oils and fats and discharged oils and fats which can be treated by the present invention, it is possible to treat them without considering the containing ratio of saturated fatty acids•unsaturated fatty acids. Waste oils and fats of the present invention means oils and fats which are treated by alkali or refined during a rendering process, however, also not treated oils and fats can also be treated. Specifically, animal oils such as tallow (Fedd oil), bovine bone oil, pig oil (lard), pig bone oil, chicken oil, sheep oil, goat oil, horse oil or fish oil or a vegetable oil such as palm oil, residue oil of palm oil, coconut oil and residue oil of coconut oil, soy bean oil, rape seed oil, sunflower oil or corn oil can be mentioned.

Further, regarding an ozone treatment, since the double or triple bonds of saturated or unsaturated fatty acids become easy to dissociate by light, ozone is injected from a lower part of each treating reaction tank and specific treatment is performed on an ozone injection opening so that the ozone reaction progresses smoothly. The specific treatment means that a metallic net having 0.5 μm to 1 μm openings is provided in a pipe of an ozone-injection opening. By providing said fine metallic net, the ozone is divided into ultra fine bubbles and the reaction can progress smoothly.

These waste oils and fats or discharged oils and fats (shortened to simply oils) should be set to a state of just prior to hydrolysis. For the purpose of setting the state of just prior to hydrolysis, it is necessary to add moisture (vapor) to the oils and to carry out heat treatment and desirable to use a pressure of 3-10 atmospheres to shorten the treating time. By setting to a state of just prior to hydrolysis, stable saturated fatty acids become easier to react by light irradiation and ozone treatment.

Ozone treatment and light irradiation treatment are carried out on the oils which are at a state of just prior to hydrolysis. Either ozone treatment or light irradiation treatment can be carried out first. Regarding the light irradiation treatment, it is desirable to change the wave-length of the light to be irradiated according to the type of oil, for example, in a case of producing Diesel engine fuel from tallow, a desirable wave-length of light is 155 nm to 325 nm, which belongs to the domain of ultraviolet. Further, according to the power of a ray-generating source, light of 185 nm to 256 nm can be used. Furthermore, in a case of producing an oil which does not solidify at approximately 0° C., which is used in food processing or cosmetic composition processing, it is possible to cause a cleavage reaction and produce an oil which does not solidify at approximately 0° C. by combining ultraviolet light, visible light and infra-red light of 356 nm-405 nm-800 nm.

EXAMPLE

Example 1

Figure 2:
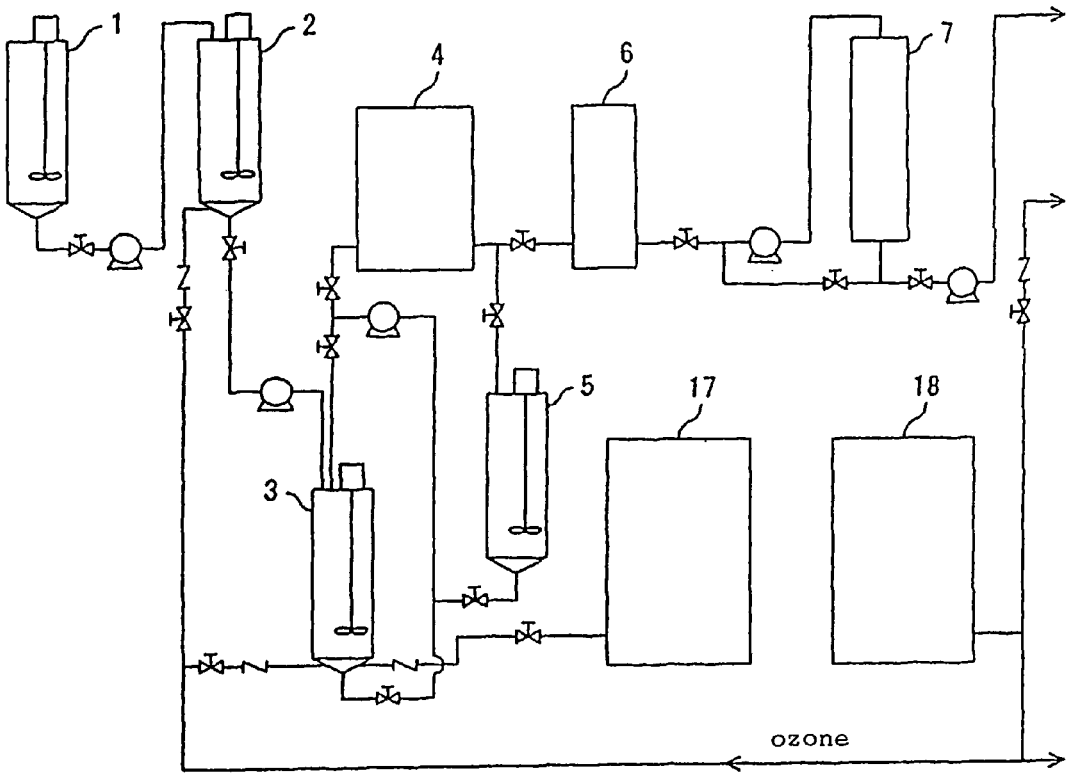
FIGS. 2 and 3 illustrate views of a treatment apparatus of the present invention.
Figure 3:
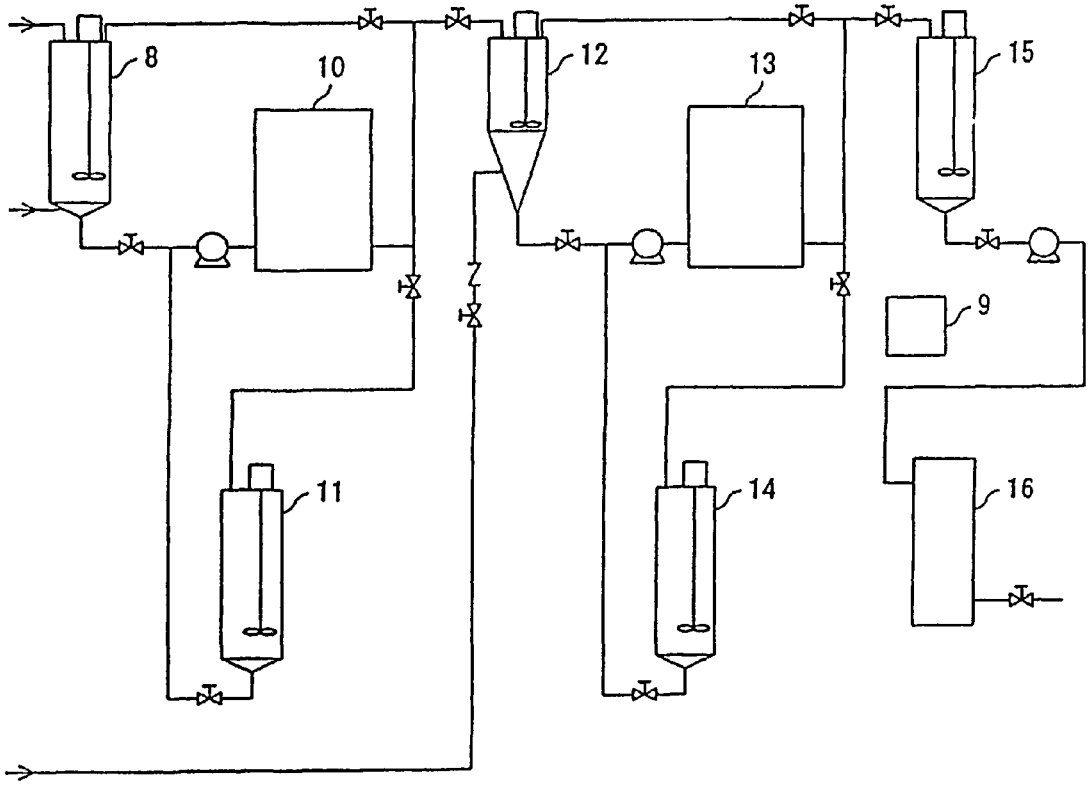

As an Example of the present invention, the flow sheet of FIG. 1, which relates to a process of producing Diesel engine fuel from tallow, will be illustrated. FIGS. 2 and 3 illustrate equipment of the present invention and, however, are not intended to restrict the scope of claims of the present invention.

(a) Material is supplied to a material tank (1) of approximately 20 L capacity. Various oils can be used as the material, and the material is heated in the material tank according to the purpose of the treatment. The material is regulated by adding 3-5% of water to the total amount of the material if necessary.

(b) The regulated oil is transferred to a first pre-treatment tank (2). The first pre-treatment tank (2) has a capacity of approximately 20 L, which is the same volume as the material tank. Since the purpose is to produce Diesel engine fuel from tallow, 3-8% of vapor to the total amount of the material is blown from the lower part of the tank so as to control the temperature to 120° C.-130° C., and ozone, which is generated from an ozone generating device (18), is introduced from the lower part of the tank. This pre-treatment reacting apparatus is at a pressure of 1-2 atmospheres and stirred well. The material is reacted to a state of just prior to hydrolysis. For the purpose of shortening the treating time, it is possible to pressurize the apparatus to 3-10 atmospheres. Further, this reacting apparatus is heated to 150° C.-250° C. and 5-8% or 10% of vapor to the total amount of the material is added and ozone is introduced. After this process, said reacting apparatus is put under a vacuum of minus 2-3 or 5 atmospheres and vapor (water) used in the previous process is removed. Thus, the material is reacted to a state of just prior to hydrolysis.

(c) Then the material, which is in a state of just prior to hydrolysis in the first pre-treatment tank, is poured into a second pre-treatment tank (3). To the material poured into the second pre-treatment tank (3), a stirrer which can pulverize the material to ultra fine particles and stir it at a rotating speed of 300-400 r.p.m. The stirrer, which can pulverize the material to ultra fine particles, of the present invention is characterized in that a stainless steel wire brush is equipped at a pointed end of the stirrer or using a propeller processed to have a sawtooth shape.

By providing a heater with the equipment of the present invention, humidity (vapor) which cannot be removed by a vacuum process is removed by heating. The heating is carried out at the temperature of 95° C.-100° C. or 100° C.-120° C. Impurities are extracted from the material oil, which is in a state of just prior to hydrolysis. For the purpose of removing impurities, the material oil passes through a first filtration device and, during said process, ozone is added from the lower part of the equipment. During the process of adding ozone and to promote oxidization, for the purpose of suppressing excess oxidization, 1-2% of sawdust or woody tips to the total amount of the material is added.

(d) First filtration device: Material which has passed through the second pre-treatment process passes through the first filtration device for the purpose of removing impurities extracted in the second pre-treatment process, such as glycerin or an absorbing agent added to the process, such as woody tips, are removed. The first filtration device consists of a pre-filtration filter press (4), a filtering cloth of the pre-filtration filter press (4) is coated with an absorbing agent such as activated clay, diatomaceous earth, zeolite or activated carbon. Accordingly, impurities formed in the second pre-treatment device are absorbed and removed. The amount of the absorbing agent is 1-3% to the total amount of the material or, according to the type of material, 2-6% to the total amount of the material.

(e) Oil separator: The purpose of an oil separator is to remove humidity remaining from the previous vacuum dehydration process. That is, material contained in the second pre-treatment device is filtered by the first filtration device and sent to the oil separator (6). The oil separator removes emulsified water remaining in the second pre-treatment device. The emulsified water originates from humidity (vapor) that is used in the material tank and in the first pre-treatment device and is not removed by the second pre-treatment device.

The shape of the oil separator is cylindrical. Material is poured into the cylinder and discharged to the outside of the cylinder. This cylinder is specifically processed. Namely, the diameter of holes to pass through become larger from an inner side toward an outer side. The diameter of the holes of the innermost side is 1 μm and the diameter of the holes of the outermost side is from 20 μm to 30 μm and, by enlarging the size of the fine particles (clusters) of emulsified material (oil•water), oil and water is instantly separated when discharged outside of the cylinder.

Separated oil progresses to the next process and separated water is transferred to a vapor generating device for the purpose of reuse after being filtered by activated carbon.

(f) Special ray irradiation device: Material (oil), after water is separated, is sent into a special ray irradiation device (7). When producing Diesel engine fuel from tallow, the wavelength of the light to be used in the present invention is a wavelength of the ultraviolet domain of 155 nm-325 nm. Further, according to the power of the ray generating source, light of 185 nm to 256 nm can be used. When using oils and fats whose containing ratio of saturated fatty acid is high for a use except for fuel, for example, to produce an oil which does not solidify at approximately 0° C., which is used in food processing or cosmetic compounds processing, it is possible to cause a cleavage reaction and to produce said oil which does not solidify at approximately 0° C. by combining ultraviolet light, visible light and infrared light of 356 nm-405 nm-800 nm.

Figure 4:
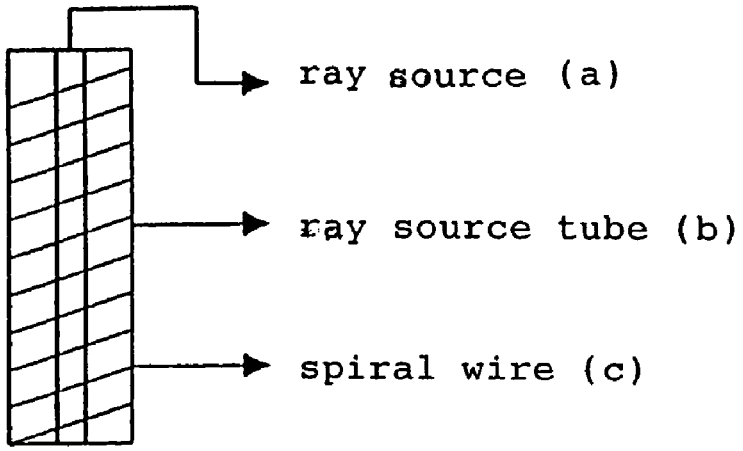
FIG. 4 is an illustration view of a light irradiation apparatus of the present invention.

As a method for irradiation, a spiral wire of glass or silicone is wound around a ray source tube, and the material flows along the spiral wire from the upper side to the lower side so as to irradiate light. One example is shown in FIG. 4.

As the other method for irradiation, a method of irradiating by spraying the material in state of a mist or fog, a dipping method, or a wet wall method can be used. Namely, it is important to expand the irradiation area.

For the next step, the process is illustrated according to FIG. 3.

(g) First treating apparatus: When producing fuel, the material after the process by a special ray irradiation device (7) indicates an igniting feature at this stage. As for oils not for fuel, the material after said process does not solidify at approximately 0° C. In the case of fuel producing, the purpose of the first treating tank (8) is to improve the quality as fuel, and in the case of oils not for fuel, the purpose of the treatment is to enhance the value. To the transported material, 1-2% of rice-bran to the total amount of the material is added. An oil washing process by rice-bran is carried out and, simultaneously, ozone is injected through an ozone inserting opening so as to carry out an ozone reaction. (18) is an ozone generating device.

(h) Second filtration device: The inside of the second filtration device (10) is coated by a cake layer selected from the group consisting of activated clay, diatomaceous earth, zeolite or activated carbon, which is transported from a pre-coating tank (11). By this cake layer, rice-bran added during the first treating process by 1-2% to the total amount of the material is removed and the quality of the oils is improved.

(i) Second treating apparatus: Material after passing through the second filtration device (10) is transferred to a second treating tank (12). The object of this tank is to improve the oils containing a high amount of a saturated fatty acid whose melting point is high, such as an animal oil, palm oil or vegetable oil not to solidify at a temperature lower than 0° C. The material is cooled down by a cooling chiller provided at the inside of the tank according to the purpose. The chilling temperature and the effect by chilling are as follows.

Material which has passed through each refining process is transported to a second treating tank and a second filtering device. When the material treated in the second treating tank is cooled down to 5° C. by a cooling chiller, then passed through the second filtering device, the filtrated material does not solidify at a temperature of from −7° C. to −15° C. in a refrigerator.

Material is cooled down to 10° C. does not solidify up to −5° C. to −7° C.

Material is cooled down to 5° C. does not solidify up to −7° C. to −15° C.

Material is cooled down from 0° C. to 1° C. does not solidify up to −20° C. to −30° C.

(j) Third filtration device: Inside of a third filtration device (13) is coated by a cake layer selected from the group consisting of activated clay, diatomaceous earth, zeolite or activated carbon, which is transported from a pre-coating tank (14). Material after being treated by the second treating apparatus (12) passes through a cake layer of the third filtering device (13) is filtered and introduced to a regulating tank (15). Then the material passes through a cartridge tank and an aimed product is produced.

The physical properties of the product obtained by conversion of tallow (Fedd oil) to Diesel engine fuel is summarized in Table 1 in comparison with a methylesterfication method and light oil on the market.

TABLE 1

| | Tallow after treated | Methylesterfication method | Light oil |
|---|---|---|---|
| Calorific value Cal/kg | 10.733 | 9500 | 10920 |
| Density (15° C.) g/cm$^3$ | 0.888 | 0.888–0.90 | 0.835 |
| Dynamic viscosity mm$^2$/S | 8 | 8–9 | 5–6 |
| Flashpoint ° C. | 37 | 130–140 | 66 |
| Fluidizing point ° C. | −7.5 | Max −5 | −8 |
| Sulfur contents % | 0.0016 | 0.01 | <0.2 |

Pig oil (lard oil) whose solidifying point (freezing point) is +30° C. is refined by the above-mentioned apparatus and, as a result, a liquid oil whose freezing point is −5° C. is obtained.

Example 2

Figure 5:
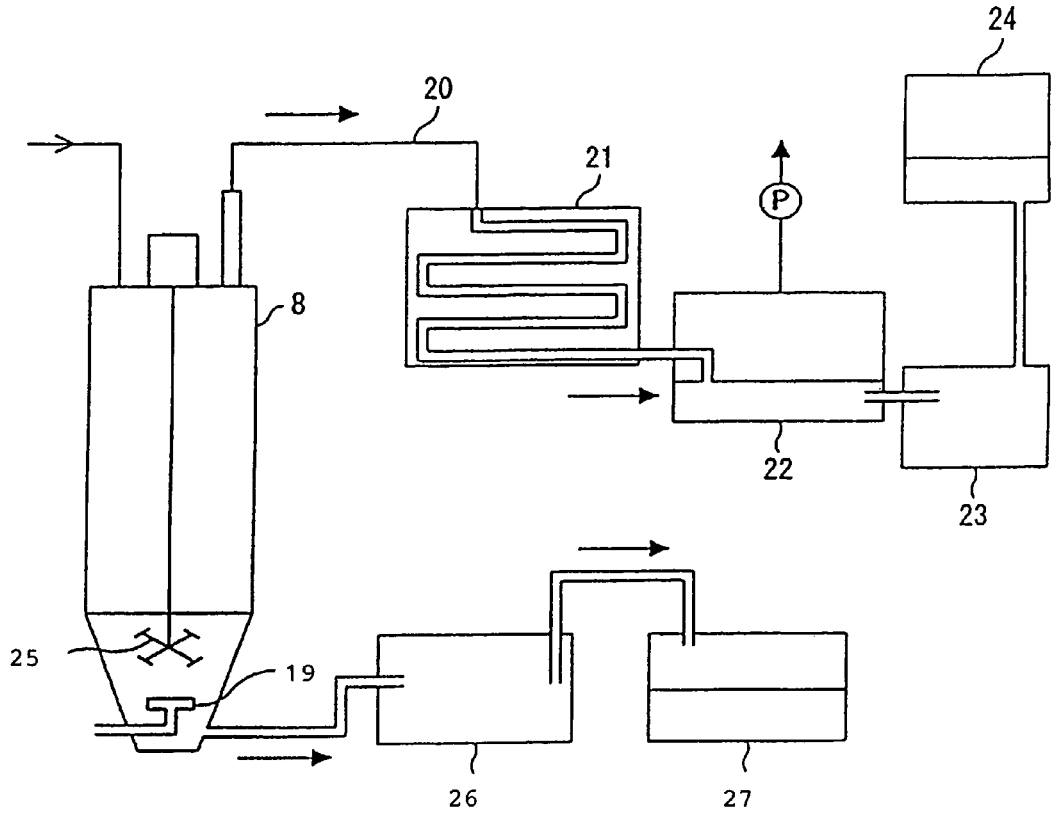
FIG. 5 is an illustration view of another example of a treatment apparatus of the present invention. The numerals in the drawing are as follows.

In this Example, a method of obtaining lubricating oil or fuel to be used instead of gasoline will be illustrated based on FIG. 5.

The same as with Example 1, according to the process shown in FIG. 2, (f) material after light irradiation treatment by a special ray irradiation device is transported to a first treating device (8). (In FIG. 2, a special ray irradiation device (7) is the same apparatus.)

l) Material after the ray irradiation treatment is transferred to a first treating tank (8). After being transferred, 3-10% of a gas-inducing agent to the total amount of the material is added to the material and stirred well. The rotating speed of the stirrer is approximately 300 r.p.m. As a gas-inducing agent, hexane, etc., can be used.

As the result of the light irradiation, hydrocarbon oil is formed in a 20-30% ratio in the transferred material.

At the inside of the first treating apparatus, a specially processed ozone inserting opening (19) is provided and from this opening, fine bubbles of ozone of 0.1 μm-05 μm size are blown in strongly and the blown in ozone emulsifies the material instantly. From the emulsified material, hydrocarbon gas is formed. The formed gas is transferred to a gas recovering apparatus mentioned below and liquefied. The liquefied product is almost the same as gasoline of a high octane value. The recovering ratio from the material is 40-50% and 50-60% of the residue is lubricating oil.

Gas Recovering Apparatus

The gas recovering apparatus is composed of first tank (21), second tank (22) and a filtration device (23). First tank liquidates gas discharged from the first treating apparatus through a pipe (20) and second tank acts as a recovering part of liquefied liquid. Functions can be illustrated as follows.

(a) Gas discharged from the pipe (20) is introduced into a spiral pipe formed inside of the first tank (21).

(b) A proper quantity of water is contained in the first tank (21), said water is kept at 0° C. and by quenching, the gas is liquefied.

(c) Aiming at smooth liquidation of the gas, a vacuum pump is equipped with the second tank (22) (recovering part) and operated to improve the recovering effect.

For the purpose of improving the quality, the recovered liquid is filtered by a filtration device (23). As a method for filtration, filtration by a filter press, vacuum filtration or spontaneous filtration can be mentioned. As a filter, activated carbon, activated clay or zeolite can be used. The filtered liquefied gas fuel is preserved in a liquefied gas fuel tank (24).

Material remaining in the first treating apparatus causes a polymerization reaction by the effect of fine particles of ozone regulated to 2-5 μm size discharged from an ozone injecting opening (19) provided at the lower part of the apparatus. To more rapidly and accurately cause the polymerization reaction, stirring is carried out. A desirable rotating speed is 10000-30000 r.p.m. However, if a stirrer at the end of a rotating axis of which a special processed stirrer (25) is provided, the rotating speed can be 300-360 r.p.m.

The stirrer (25), is not restricted, however, when a stirrer characterizing by a wire brush of 0.1-0.3 mm size is equipped at a pointed end of the rotating axis having a cross shape or a stirrer using a propeller processed to have a sawtooth shape is used, a remarkable effect can be obtained.

The filtration process is for the purpose of improving the quality of the polymerized material. The filtrating operation is carried out the same as the above-mentioned gas recovering process. That is, a filtering device (26) can be a filter press, vacuum filtration or spontaneous filtration and, as a filter, activated carbon, activated clay or zeolite can be used. The polymerized material, after the filtration process, is recovered at a lubricating oil recovering device (27).

From this treated material, a lubricating oil of a hardness of 10w-30-10w-40 for a gasoline engine or for a Diesel engine can be produced.

APPLICABILITY FOR INDUSTRIAL USE

By the treating method of the present invention, oils and fats whose content of saturated fatty acid, which is recognized to be hard to refine, can be refined by a simple refining method and can be provided as a material for various oils and fats. That is, this method is suited to a treating method of oils and fats whose content of stable saturated fatty acids, waste oils and fats or, in particular, waste oils and fats linked to mad cow disease, and is useful for producing Diesel engine fuel, lubricating oil or fuel and can be used instead of gasoline.

What is claimed is:

1. A method of treating oils and fats to form a product oil suitable for use as a fuel, and method comprising the steps of:

providing an oil and/or fat;

introducing the oil and/or fat into a treatment vessel;

adding moisture to the oil and/or fat and conducting a heat treatment of the oil and/or fat at a pressure less than 10 atmospheres to obtain a pre-hydrolyzed oil and/or fat; and carrying out an ozone treatment and a light irradiation treatment on the pre-hydrolyzed oil and/or fat and forming the product oil.

2. The method of claim 1, wherein the oil and/or fat is a waste oil or fat or a discharged oil or fat.

3. The method of claim 1, wherein the at least one of an oil and a fat is at least one member selected from the group consisting of an animal oil, an animal fat, a vegetable oil and a residue of a vegetable oil.

4. The method of claim 3, wherein the animal oil is bovine bone oil, pig oil, pig bone oil, sheep oil, goat oil or horse oil.

5. The method of claim 3, wherein the animal fat is tallow.

6. The method of claim 3, wherein the vegetable oil is palm oil or coconut oil.

7. The method of claim 1, wherein the pre-hydrolyzed oil and/or fat is subjected to the ozone treatment and then to the light irradiation treatment.

8. The method of claim 1, wherein the pre-hydrolyzed oil and/or fat is subjected to the light irradiation treatment and then to the ozone treatment.

9. The method of claim 1, wherein the light irradiation treatment combines ultraviolet light, visible light and infrared light.

* * * * *